US005518772A

United States Patent [19]

Andachi et al.

[11] Patent Number: 5,518,772

[45] Date of Patent: May 21, 1996

[54] METHOD FOR ADJUSTING COATING WEIGHT BY GAS WIPING

[75] Inventors: Kazunari Andachi; Harumi Shigemoto, both of Kurashiki, Japan

[73] Assignee: Kawasaki Steel Corporation, Hyogo, Japan

[21] Appl. No.: 351,377

[22] PCT Filed: Apr. 28, 1993

[86] PCT No.: PCT/JP93/00555

§ 371 Date: Dec. 13, 1994

§ 102(e) Date: Dec. 13, 1994

[87] PCT Pub. No.: WO94/05179

PCT Pub. Date: Oct. 11, 1994

[51] Int. Cl.[6] ..... B05D 3/04

[52] U.S. Cl. ..... 427/349; 427/348; 427/431; 427/434.2

[58] Field of Search ..... 427/348, 349, 427/431, 433, 434.2

[56] References Cited

U.S. PATENT DOCUMENTS 4,078,103 3/1978 Thornton et al. ..... 427/349
4,153,006 5/1979 Thornton et al. ..... 418/63

FOREIGN PATENT DOCUMENTS 54-135628 10/1979 Japan .
63-149957 10/1988 Japan .
1-92349 4/1989 Japan .
3-173756 7/1991 Japan .

*Primary Examiner*—Shrive Beck
*Assistant Examiner*—Katherine A. Bareford
*Attorney, Agent, or Firm*—Oliff & Berridge

[57] ABSTRACT

A method of adjusting coating weight of a coating material with high accuracy within a wide range of operation, by setting and using a relational formula for determining a coating weight W of the coating material separately in accordance with relative relation between a nozzle-strip distance D and a nozzle slit clearance B. The adjustment of the coating weight of molten metal (coating material) is performed by controlling a nozzle pressure P and a strip speed V, and also by controlling D by equation (1) in the range of D/B≦C (developing range) and at least one of D and B by equation (2) in the range of D/B>C (fully developed range). ($\rho_M$=molten metal density, μ=molten metal viscosity, $P_A$=pressure at nozzle outlet, η= nozzle efficiency, K=ratio of specific heat of gas, and $h_1$ and $h_2$=constants)

$$W=h_1\times\rho_M\times\{(K-1)/(2\times\eta\times K\times P_A)\}^{1/2}\times D^{1/2}\times[\mu\times V/\{(P/P_A)^{(K-1)/K}-1\}]^{1/2} \quad (1)$$

$$W=h_2\times\rho_M\times\{(K-1)/(2\times\eta\times K\times P_A)\}^{1/2}\times(D/B^{1/2})\times[\mu\times V/\{(P/P_A)^{(K-1)/K}-1\}]^{1/2} \quad (2)$$

6 Claims, 9 Drawing Sheets

METHOD FOR ADJUSTING COATING WEIGHT BY GAS WIPING

TECHNICAL FIELD

The present invention relates to a method for adjusting coating weight by gas wiping and, more particularly, to a method for adjusting coating thickness by gas wiping excessive coating material with blows of gas injected from a wiping nozzle in the course of continuous coating of molten metal or paint to a strip.

BACKGROUND ART

Generally, in continuous molten metal plating and continuous painting, a so-called gas wiping is widely adopted in which an excessive amount of coating material such as a molten metal, paint, etc. is continuously coated on the surface of a strip and at the same time blows of gas are applied to the surface by use of a wiping nozzle to remove excessive coating material.

In the above-described continuous molten metal plating and continuous painting, it is a matter of great importance to accurately adjust the coating weight of a coating material such as the molten metal, paint, etc. on a strip to a target value.

The adjustment of the coating weight of a coating material on a continuous molten metal plating line and a painting line is subdivided into many types from the points of diversified purposes, corrosion resistance, and cost of products. Therefore, not only when the type of product is to be changed but when the target coating weight is to be changed, it is necessary to properly and rapidly change and set the nozzle injection pressure P, nozzle-strip distance D, slit clearance B of a wiping nozzle, strip velocity V, etc.

As a method of coating weight adjustment to be made in the course of molten metal plating, methods disclosed for example in Japanese Patent Laid-Open No. Sho 54-149331, Japanese Patent Publication No. Sho 56-12316 and Japanese Patent Laid-Open No. Hei 1-92324 have been known.

In Japanese Patent Laid-Open No. Sho 54-149331, a gas pressure on the surface of a strip is considered to be a function of a distance from a plating bath surface, and nozzle height, nozzle-strip distance, and gas injection pressure are adjusted to satisfy the function; in Japanese Patent Publication No. Sho 56-12316, the coating weight of plating is adjusted by utilizing the gas injection pressure expressed as the function of the distance, height and angle of nozzle, line speed, and coating weight of plating; and in Japanese Patent Laid-Open No. Hei 1-92324, the coating weight of plating is adjusted by using a relational formula of a wiping pressure and coating weight and a relational formula of a nozzle distance and coating weight, at the time of feedback control of coating weight of plating immediately above the nozzle.

There have been generally practiced such a method of feedback control of the coating weight of plating (deposit of coating material) based on wiping nozzle injection pressure P, nozzle-strip distance D, strip velocity V, and molten metal coating weight W, and a method of feed-forward control by using a relational formula of the molten metal coating weight W and operation factors.

Generally, when the feed-forward control or feedback control is carried out, the wiping nozzle injection pressure P and the nozzle-strip distance D are determined on the basis of the relational formula of the coating weight W of the coating material and operation factors in accordance with a target coating weight for the purpose of adjusting the coating weight of the coating material such as the molten metal, paint, etc. to be applied to a continuously moving strip. Therefore, in order to accurately adjust the coating weight of the coating material, it becomes important that the above-described relational formula to be used for control can properly and accurately express the wiping phenomenon of molten metal or paint throughout the range of operation.

DISCLOSURE OF THE INVENTION

However, the relational formula used in the prior art methods of coating weight adjustment by gas wiping that have been disclosed in the gazettes stated above are empirical formulas experimentally obtained from a correlation of factors, being uniformly applied without the range of operation taken into consideration.

Therefore, there exists an error between a calculated value of coating weight determined from the relational formula and an actually measured value; the wider the range of operation (a range of variation of operation factors), the greater the error will increase, resulting in an increased volume of such products that the actual coating weight of the coating material will be off a target value (within a specific value of $\pm 2$ g/m$^2$ in an example of hot-dip galvanized steel sheets for automobiles).

An error of the coating weight of the coating material from the target value resulting from inaccuracy of the relational formula appears as a steady-state deviation, not only in the feed-forward control but also in the feedback control, preventing high-accuracy adjustment of the coating weight of the coating material.

In view of the above-described various disadvantages inherent in the heretofore known arts, it is an object of the present invention to provide a method for adjusting coating weight by gas wiping which can establish an appropriate relational formula between the coating weight and operation factors to thereby accurately adjust the coating weight of a coating material on the basis of the relational formula. That is, when changes have been made in the operation factors owing to a change in the type of products or a strip shape and so on, the coating weight of a coating material such as molten metal, paint, etc. applied to strips can be controlled to a target value according to conditions of these changes.

In the method for adjusting coating weight by gas wiping, the present invention has obviated the above disadvantages by adjusting the coating weight of a coating material applied to a strip, on the basis of the relational formula of coating weight which differs with a relation between the wiping nozzle slit clearance B and the nozzle-strip distance D with respect to a constant C, that is, between (i) $D/B \leqq C$ and (ii) $D/B > C$, when the coating weight of the coating material on the strip is adjusted by applying blows of gas, from the wiping nozzle disposed at the downstream side of a continuous coating apparatus for continuously coating the strip, against the strip coated by the continuous coating apparatus.

The present invention has solved the above-described problems arising in the molten metal plating by the method for adjusting the coating weight of a coating material on a strip by gas wiping in which a wiping nozzle is disposed above a molten metal bath to apply blows of gas from the wiping nozzle against the strip that has passed through the molten metal bath, thereby adjusting the coating weight of molten metal on the strip on the basis of the relational formula of coating weight which differs with a relation between the wiping nozzle slit clearance B and the nozzle-strip distance D with respect to a constant C, that is, between (i) D/B≦C and (ii) D/B>C.

The present invention has solved the aforesaid problems arising in continuous painting by the method for adjusting the coating weight by gas wiping in which a wiping nozzle is disposed on the downstream side of a continuous painting apparatus to apply gas from the wiping nozzle against the strip that has passed through the continuous painting apparatus, thereby adjusting the coating weight of paint on the strip on the basis of the relational formula of coating weight which differs with a relation between the wiping nozzle slit clearance B and the nozzle-strip distance D with respect to a constant C, that is, between (i) D/B≦C and (ii) D/B>C.

Furthermore, in the method for adjusting the coating weight by gas wiping of the present invention, the coating weight of a coating material on a strip is adjusted by a relational formula of coating weight exclusive of the slit clearance B in the case of (i) D/B≦C and by a relational formula of coating weight inclusive of the slit clearance B in the case of (ii) D/B>C.

Furthermore, in the method for adjusting the coating weight by gas wiping of the present invention, the coating weight of a coating material on a strip is adjusted on the basis of a relational formula of coating weight while maintaining a relation of D/B≦C by controlling at least one of the wiping nozzle slit clearance B and the nozzle-strip distance D.

The present invention has been accomplished on the basis of information hereinafter described which the present inventor has acquired through varieties of investigations. The following description will be made primarily of molten metal plating using a molten metal as a coating material for convenience' sake.

A first information obtained from a result of theoretical analysis of a molten metal wiping phenomenon by gas indicates that it is important to separately consider a relational formula of the coating weight and operation factors with a correlation between the wiping nozzle slit clearance B and the nozzle-strip distance D divided into the following two cases according to characteristics of gas jet from the wiping nozzle.

(i) D/B≦C (ii) D/B>C where C corresponds to a constant which specifies a boundary between a developing range and a fully developed range of gas jet from a wiping nozzle described later. Actually, this constant is experimentally determined by the type and temperature of wiping gas, and a nozzle configuration; usually a value of around 5 to 9 is used.

Hereinafter the above-described theoretical analysis will be described in detail with reference to FIGS. 2 to 4.

As shown in FIG. 2, a strip S is drawn upward after dipping through a plating bath 12 of molten metal contained in a plating tank 10, then blows of gas are applied at an injection pressure P against the surface of the strip S from wiping nozzles 14 at a level H above the plating bath 12 to wipe off excessive molten metal from the surface of the strip S.

FIG. 3 schematically shows the wiping condition of the molten metal in the position of the wiping nozzle 14. When the gas jet F is being applied at the pressure P from the wiping nozzle 14 against the strip S that has been drawn upward out of the plating bath 12 of molten metal, the fluid behavior of the molten metal on the strip S can be expressed by the following equations (1) and (2) in a system of coordinates of the same drawing, by the use of an equation of motion and an equation of continuity in the fluid dynamics.

A theoretical analysis will hereinafter be made on the basis of the equations (1) and (2). These equations have been disclosed in for example U.S. Pat. No. 4,078,103.

$$\mu\times(\partial^2 u/\partial y^2)=\rho_M\times g+dP/dx \quad (1)$$

$$V\times t=\int_0^{\delta} u(x,y)dy \quad (2)$$

where $\mu$=viscosity of molten metal $\rho_M$=molten metal density u=velocity distribution of molten metal g=gravity acceleration P=gas pressure acting on molten metal surface t=final coating weight V=strip speed x, y=coordinates $\delta$=thickness of molten metal in x position A relation of the gas pressure at the maximum pressure gradient of $|dP/dx|_{max}$ is found by solving the equation (1) under the boundary condition that u=V when y=0 and (d'u/d'y)=0 (d' expresses a partial differential) when y=$\delta$, and simultaneously with the equation (2), thus obtaining the equation (3). In the equation (3), | | represents an absolute value (also in each of the equations (4), (8), and (9) given below).

$$t=\{(4/9)\times\mu\times V/|dP/dx|_{max}\}^{1/2} \quad (3)$$

From the equation (3) the coating weight W can be derived from the following equation (4).

$$W=\rho_M\times t=\rho_M\times\{(4/9)\times\mu\times V/|dP/dx|_{max}\}^{1/2} \quad (4)$$

In the meantime, according to a two-dimensional free jet theory, the jet range may be considered in two divided ranges: the developing range consisting of a mixed range inclusive of a potential core in which the core velocity of the gas jet F is not decrease and both sides thereof, and the fully developed range in which the jet becomes fully developed turbulence. The velocity distribution in these two ranges is expressed by the equation (5) and the equation (6).

(i) Developing range (D/B≦C)

$$v=(v_0/2)\times\{1+erf(\sigma_1\times x/D)\} \quad (5)$$

where, erf $(\xi)=(2/\sqrt{\pi})\int_0^{\epsilon}\exp(-z^2)dz, \xi=\sigma_1\times x/D$ (ii) Fully developed range (D/B>C)

$$v=C_0\times v_0\times(B/D)^{1/2}sech^2(\sigma_2\times x/D) \quad (6)$$

where v=jet speed $v_0$=uniform flow velocity at nozzle outlet

D=distance from nozzle in the direction of jet centerline

B=nozzle slit clearance $\sigma_1$, $\sigma_2$, $C_0$=constants

The dynamic gas pressure is expressed by the following equation (7), where $\rho_A$ is gas density at the nozzle outlet.

$$P=(1/2)\rho_A\cdot v^2 \quad (7)$$

With the equation (5) or (6) applied to the equation (7), the maximum pressure gradient can be expressed by the following equation (8) or (9).

(i) Developing range $$|dP/dx|_{max} = 0.3441 \times \sigma_1 \times \rho_A \times v_0^2/D \quad (8)$$
$$= 3.785 \times \rho_A \times v_0^2/D$$
$$(\sigma 1 = 11.0)$$

(ii) Fully developed range $$|dP/dx|_{max} = 0.5724 \times C_0^2 \times \sigma_2 \times \rho_A \times v_0^2 \times B/D^2 \quad (9)$$
$$= 4.390 \times C_0^2 \times \rho_A \times v_0^2 \times B/D^2$$
$$(\sigma_2 = 7.67)$$

The gas jet velocity $v_0$ included in the equations (8) and (9) can be determined by supposition of isoentropic flow.

From the law of conservation of energy the following equation (10) is established. Also, in the case when the gas jet flow is rapid, a change of state occurs within a short time and the change is an adiabatic change, that is, an isoentropic change, the following equation (11) is derived.

$$v^2/2+\int dP/\rho=const \quad (10)$$

$$P/\rho^K=const \quad (11)$$

K=ratio of specific heat of gas (diatomic molecule: K=1.4)

From the equations (10) and (11), the law of conservation of energy of the isoentropic flow can be expressed by the following equation (12), where $P_A$ is a pressure at the nozzle outlet section.

$$v^2/2+\{K/(K-1)\}\times P/\rho= v_0^2/2+\{K/(K-1)\}\times P_A/\rho_A \quad (12)$$

In the equation (12), when the flow velocity v in the nozzle is equal to 0, the following equation (13) is obtainable by using the relation of the equation (11).

$$v_0=[\{2K/(K-1)\}\times(P_A/\rho_A)\times\{(P/P_A)^{(K-1)/K}-1\}]^{1/2} \quad (13)$$

Since there is an energy loss owing to the nozzle or other in actual operation, the following equation (14) is used with the nozzle efficiency $\eta$ taken into consideration.

$$\rho_A\times v_0^2=\eta\times\{2K/(K-1)\}\times P_A\times[(P/P_A)^{(K-1)/K}-1] \quad (14)$$

Next, substituting the equation (14) in the equation (8) or (9), and further these equations (14) and (8) or (9) into the equation (4), yields the following equations (15) and (16) expressing the relation of the coating weight and each control factor.

(i) Developing range (D/B≦7.483)

$$W = k\times 0.3427\times\rho_M\times D^{1/2}\times\{\mu\times V/(\rho_A\times v_0^2)\}^{1/2} \quad (15)$$
$$= h_1\times\rho_M\times\{(K-1)/(2\times\eta\times K\times P_A)\}^{1/2}\times D^{1/2}\times$$
$$[\mu\times V/\{(P/P_A)^{(K-1)/K}-1\}]^{1/2}$$
$$(h_1 = k\times 0.3427)$$

(ii) Fully developed range (D/B>7.483)

$$W = (k\times 0.3182/C_0)\times\rho_M\times(D/B^{1/2})\times\{\mu\times V/(\rho_A\times v_0^2)\}^{1/2} \quad (16)$$
$$= h_2\times\rho_M\times\{(K-1)/(2\times\eta\times K\times P_A)\}^{1/2}\times(D/B^{1/2})\times$$
$$[\mu\times V/\{(P/P_A)^{(K-1)/K}-1\}]^{1/2}$$
$$(h_2 = k\times 0.3182/C_0)$$

The equations (15) and (16) give an example of the value (7.483) of the boundary point C between the developing range and the fully developed range. In this example, literature values are used as the nozzle characteristic constants $C_0$, $\sigma_1$ and $\sigma_2$, and C was determined from Equation (15)=Equation (16). It is desirable that the value of C be given by determining these nozzle characteristic constants on the basis of actual measurements of gas jet velocity distribution.

From comparison of the equation (15) with the equation (16) it is understood that $\rho_M$, $\mu$, V, and P of the factors indicate the same degree of influence; D and B, however, show different degrees of influence. In the (i) developing range, the coating weight W is proportional to $D^{1/2}$, and in the (ii) fully developed range, the coating weight W is proportional to $D/B^{1/2}$.

From this, the following (A) to (C) will be known.

(A) In the developing range, the degree of influence of the nozzle-strip distance D becomes little.

(B) The developing range has nothing to do with the nozzle slit clearance B.

(C) It is necessary to consider the relation of the coating weight and control factors separately according to magnitude of D/B which is a ratio of D to B.

As hereinabove described in detail, it was indicated that the relation of the coating weight and each factor of influence differs by a relative relationship between the nozzle-strip distance D and the nozzle slit clearance B. Therefore, it is important to divide and consider the range according to the value of D/B, and, at the same time, to separately apply the relational formula of the coating weight as the equations (15) and (16) to respective ranges.

It is to be noted that the equations (15) and (16) give only one example and the present invention should not be limited thereto; for example the constants and an exponent are changeable as occasion calls.

According to a second information, as is clear from the equations (15) and (16), the coating weight differs in the degree of influence of the operation factors between D/B≦C and D/B>C; when B is changed, with D kept constant, the wiping efficiency rises (wiping becomes easier to perform) with a decrease in the ratio of D/B within the range of D/B>C. However, within the range of D/B≦C, the wiping efficiency remains almost unchanged even when D/B has changed. This state is shown in FIG. 5. It is generally known that the wiping efficiency rises with the decrease of D.

At the same time, it was experimentally found that splash (of molten metal) arising from the surface of a plating bath can be decreased with the lessening of wiping gas flow rate. That is, when other conditions are the same, the occurrence of splash can be decreased by reducing the slit clearance B.

A third information indicates it important that, as a result of the aforesaid theoretical analyses plus further experiments and investigations, physical properties of the molten metal which have an influence upon wiping characteristics should be evaluated as a function of temperature of the molten metal in the wiping nozzle position.

That is, as is clear from FIG. 6 which shows a relation between the plating metal (molten metal) temperature in the wiping nozzle position and a coating weight error (actually measured coating weight—calculated coating weight without the dependence of the plating metal temperature), the wiping characteristic lowers with the drop of the plating metal temperature. It has been found, however, that when the dependence of the plating temperature in the wiping nozzle position is taken into consideration, the error becomes very little.

Hereinafter a method of calculating the coating metal temperature in the wiping nozzle position and a method of considering the physical properties of the coating metal will be explained as an example by referring to FIG. 2.

As shown in FIG. 2, a strip S at a temperature $T_{z.0}$ is dipped in a plating bath 12 at a temperature $T_M$ at a line speed V, then is drawn upward at a temperature $T_{z.1}$ close to the plating bath temperature $T_M$ from the plating bath 12. The strip temperature $T_{z.1}$ of the strip S going out of the plating bath 12 is given by the following equation (17), supposing that it is based on heat transmission to a flat plate under the molten metal.

$$T_{Z.1}=T_M+(T_{Z.0}-T_M)\times exp\{-(2\times\alpha_M\times 1_M)/(\rho_S\times C_{p.s}\times t_S\times V)\} \quad (17)$$

where $\alpha_M$=heat transmission coefficient of plating bath and strip $1_M$=dipping distance under plating bath $\rho_S$=strip density $C_{p.s}$=specific heat of strip $t_S$=strip thickness The strip S at temperature $T_{z.1}$ is cooled with a wiping gas down to the coating metal temperature $T_{z.2}$ in the wiping nozzle 14 position. This temperature $T_{z.2}$ can be expressed by the following equation (18).

$$T_{Z.2}=T_g+(T_{Z.1}-T_g)\times exp\{(-2\times\alpha\times H)/(\rho_S\times C_{p.s}\times t_S'\times V)\} \quad (18)$$

where $T_g$=wiping gas temperature jetted from nozzle $\alpha$=heat transmission coefficient by wiping gas (function of nozzle pressure)

H=distance from plating bath surface to nozzle $t_s'$=sum of strip thickness and coating metal thickness converted to a standard heat capacity of strip Next, the temperature dependence of the coating metal viscosity $\mu$ is set by the following equation (19) to which the coating metal temperature derived from the equation (18) is applied. In the equation (19), $a_1$, $a_2$, and $a_3$ are constants.

$$\mu=a_1\times T_{Z.2}^2+a_2\times T_{Z.2}+a_3 \quad (19)$$

Applying the coating metal viscosity $\mu$ derived from the equation (19) to the equation (15) or (16) enables higher-accuracy adjustment of the coating weight.

In leading out the equation (18), the temperature of the coating metal immediately after the strip is drawn upward out of the plating bath 12 is presumed as equal to the strip temperature $T_{z.1}$. Under general operating conditions, the above-described two temperatures are substantially equal and accordingly there will occur no problem about the temperatures. The strip temperature and the coating metal temperature, however, may be formulated as different ones.

From the first information as described in detail above, it is clear that the forecast accuracy of a relational formula of the coating weight and the operation factors can be improved by using a relational formula (control formula) of coating weight divided by a relative relation of the nozzle-strip distance D and the nozzle slit clearance B.

Therefore, it becomes possible to perform molten metal plating to a target coating weight over a wide range of operation by controlling at least one of the nozzle-strip distance D and the nozzle slit clearance B, and the nozzle pressure P, nozzle height H, strip velocity V, etc., using the equation (15) having no connection with the nozzle thickness B in the so-called developing range and the equation (16) including both the nozzle-strip distance D and nozzle slit clearance B in the so-called fully developed range.

According to the second information, it is recommended that wiping be done within the range of $D/B \leqq C$ in order to improve the wiping efficiency, and that since the wiping gas flow rate is proportional to the nozzle slit clearance B, the narrower the slit clearance B, the smaller the wiping gas flow rate can be made, thus presenting an economical advantage.

Furthermore, splash from the plating bath surface can be decreased by narrowing the slit clearance B.

Therefore, narrowing the slit clearance B as small as possible while controlling at least one of D and B within the range which satisfies $D/B \leqq C$ can decrease the wiping gas flow rate without deteriorating the wiping efficiency and further can reduce splash.

Furthermore, a wide range of constant C from 6.6 to 8.1 inclusive of a measuring accuracy could be obtained by experiments. Therefore, it is desirable that, when to be adjusted by using the equation (15) within the developing range, the coating weight be adjusted to the range of the following equation (20) on the basis of a mean value Ca of C obtained by experiments.

$$Ca-1 \leqq D/B \leqq Ca+1 \quad (20)$$

When control of the slit clearance B to a desired value is made, a nozzle disclosed in Japanese Patent Laid-Open No. Sho 63-238254 is usable.

In Japanese Patent Publication No. Sho 49-37898 is disclosed a method for defining the slit clearance B to a certain range in accordance with an experimentally obtained relative relation of the coating weight W and the slit clearance B; however, coating weight adjustment based on the relative relation of the nozzle-slit distance D and the slit clearance B is not effected.

According to the third information, when the coating weight adjustment is made by the equation (15) or (16), temperature dependence is also taken into consideration with regard to the molten metal viscosity included in each equation, thus enabling higher-accuracy adjustment of the coating weight.

Plating of a molten metal as a coating material has heretofore been described in detail. The present invention is similarly applicable to an optional continuous painting so far as the coating material is a liquid substance such as paint.

When paint is used as the coating material, the plating bath 12 in FIGS. 2 and 3 is used as a continuous coating apparatus and the molten metal and the coating metal are replaced with paint and coating paint. At the same time, the same theory and the same equations as in the case of the molten metal plating are usable by using, in the equations (1) and (2), $\mu$=paint viscosity, $\rho_M$=paint density, u=paint velocity distribution, P=gas pressure acting on paint surface, t=final paint coating weight, and $\delta$=paint thickness in x position.

In this case, one example of a relation between the paint temperature in the wiping nozzle position and the paint coating weight error (an actual measured coating weight—a calculated coating weight without dependence of paint temperature taken into consideration), which corresponds to the relation shown in FIG. 6, is shown in FIG. 7.

It will be appreciated that the temperature dependence of the coating paint viscosity $\mu$ can be considered, applying the equation (19). However, when a paint such as water paint is applied at ordinary temperatures to a strip of ordinary temperature, the physical properties of the paint remains almost unchanged. Therefore, practically sufficient accuracy is obtainable without evaluating the physical properties of the paint as a function of temperature.

BEST MODE FOR CONDUCTING THE INVENTION

Hereinafter the embodiment of the present invention will be explained in detail with reference to the accompanying drawings.

Figure 8:
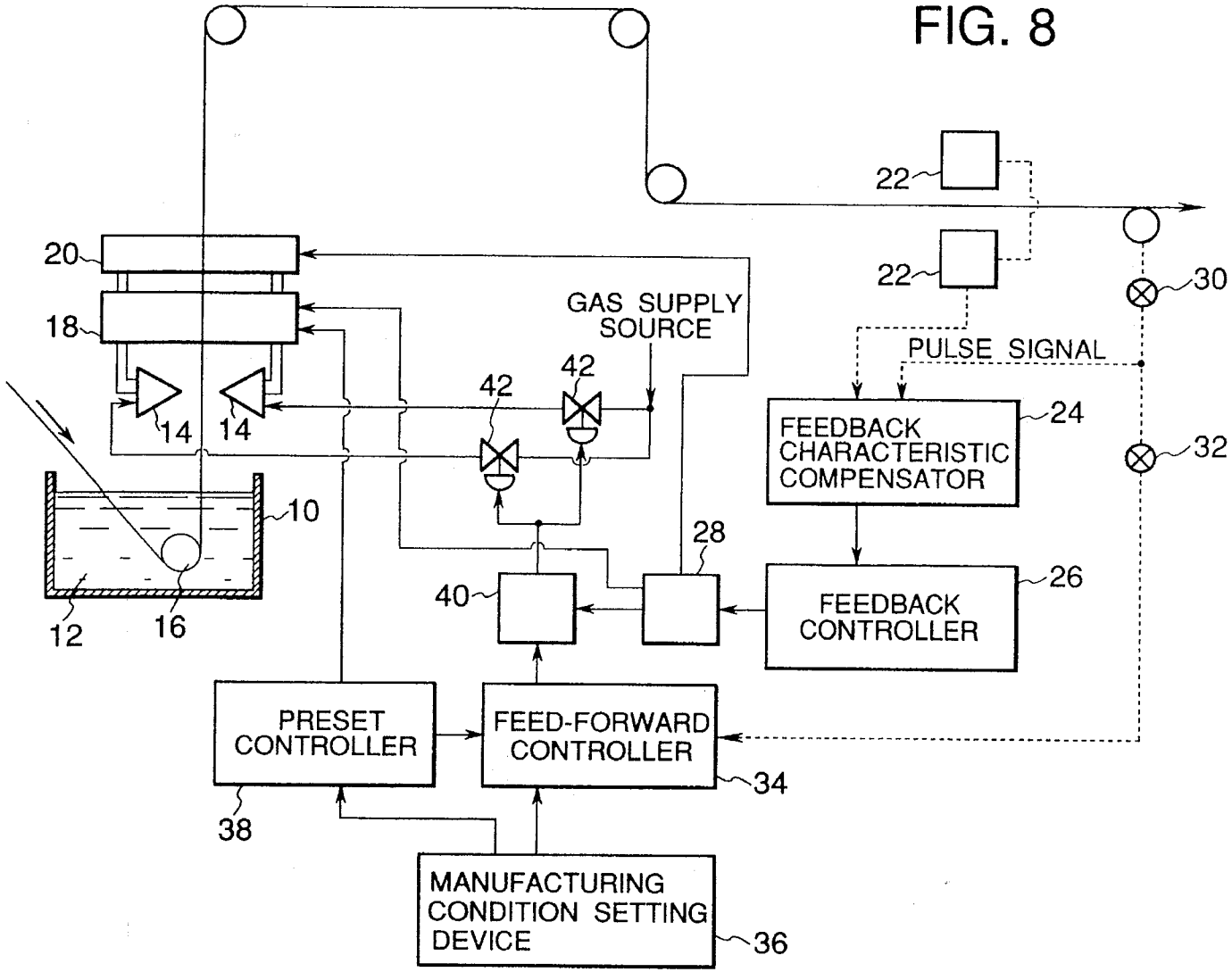
FIG. 8 is a block diagram showing a molten metal plating control apparatus applicable to the embodiment of the present invention.

FIG. 8 is a block diagram showing a molten metal plating control apparatus applied to a first embodiment of the present invention.

The control apparatus controls a continuous coating apparatus in such a manner that strip S which has been dipped through a plating bath 12 held in a plating tank 10 is drawn upward out of the plating bath 12, and is then moved. On both sides of the strip S that has been drawn upward out of the plating bath 12, a specific pressure gas is applied to both sides from wiping nozzles 14. The direction of travel of the strip S dipped in the plating bath 12 is changed by a sink roll 16.

The wiping nozzle 14 is designed so that the nozzle distance D and the nozzle slit clearance B can be adjusted by means of an adjuster 18, and the nozzle height H is also adjustable by an adjuster 20.

Ahead in the direction of travel of the strip S is disposed a film thickness meter 22 for measuring the film thickness in the direction of width. A detection signal from this film thickness meter 22 is entered into the adjuster 18 via a feedback characteristic compensator 24, a feedback control apparatus 26, and a control input selector 28.

The length and speed of travel of the strip S are measured by means of a pulse oscillator 30 and a speed converter 32 provided at the measuring roll which rotates in contact with the strip S, and are inputted into the feedback characteristic compensator 24 and the feed-forward control apparatus 34. This feed-forward control apparatus 34 receives signals from a manufacturing condition setting device 36 and a preset control apparatus 38 respectively, to thereby control the pressure control valve 42 through a pressure regulator 40. The pressure control valve 42 enables the control of pressure of gas being emitted from the wiping nozzle.

A signal from the manufacturing condition setting device 36 is inputted into the adjuster 18 through the preset control apparatus 38. Furthermore, a signal from the control input selector 28 is fed into the height adjuster 20.

Next, a brief explanation will be given of an example of representative control according to the present embodiment.

In the case of the feed-forward control, when the operating conditions such as coating weight W, line speed V, and type of steel are changed, such set values as the nozzle-strip distance D, slit clearance B, and nozzle injection pressure P are determined by the use of the equation (15) or (16) according to the coating weight W and the line speed V. At this time, the nozzle-strip distance D should be set to the lower limit or higher so that the strip will not contact the nozzle, the injection pressure P will not exceed the upper limit, and the nozzle height H will be at a normal standard value.

After the decision of the set values, the nozzle-strip distance D, slit clearance B, and injection pressure P are adjusted to set values by the adjuster 18 and the pressure regulator 40. The nozzle height H, when requiring adjustment, is to be adjusted by the adjuster 20.

In the case of the feedback control, when there exists a difference between an indicated value of coating weight based on a result of measurements by the film thickness meter 22 and a target value, and also when the line speed varies on the way, it is necessary to calculate out a variation of at least one of the nozzle-strip distance D, slit clearance B and injection pressure P in accordance with a deviation of the coating weight and a change in the line speed on the basis of the equation (15) or (16), necessary adjustments corresponding to the variation will be made by means of the adjuster 18 and the pressure regulator 40. In this case also, the nozzle height H is set basically to the standard value.

The control of the coating weight of zinc (Zn) coated by galvanizing was effected by using the controller with the calculation of the equations (15) and (16), and a result shown in FIG. 1 was obtained.

Figure 1A:
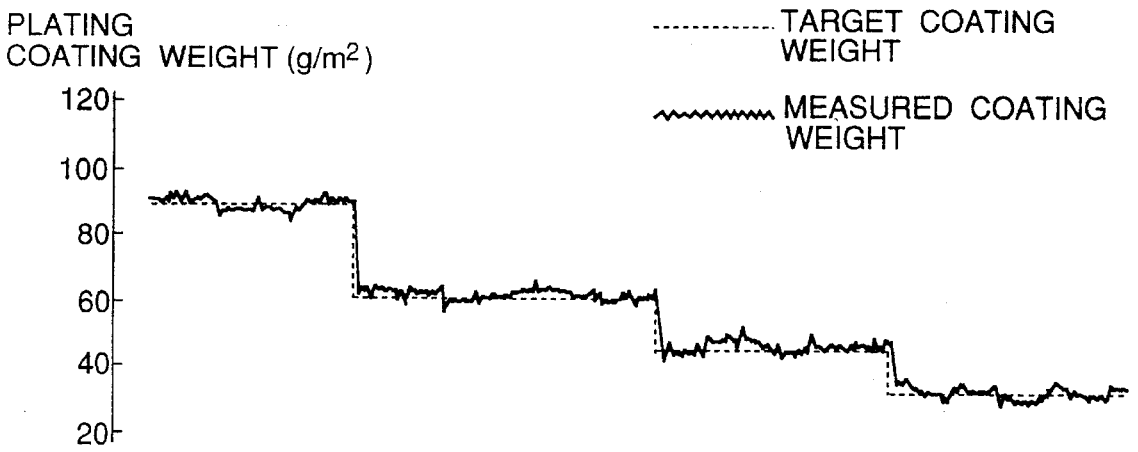
FIGS. 1A and 1B are diagrams showing the advantage of a first embodiment according to the present invention.

FIG. 1A shows a result of control of coating weight of plating with coating metal temperatures in the wiping position taken into consideration in the equations (15) and (16). Operating conditions at this time are given in Table 1.

Figure 1B:
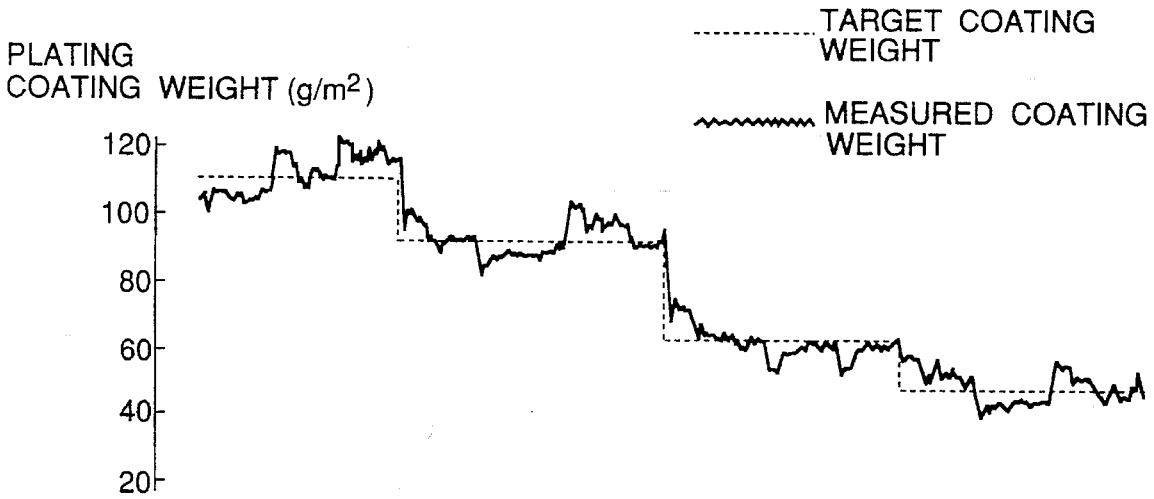
Figure 2:
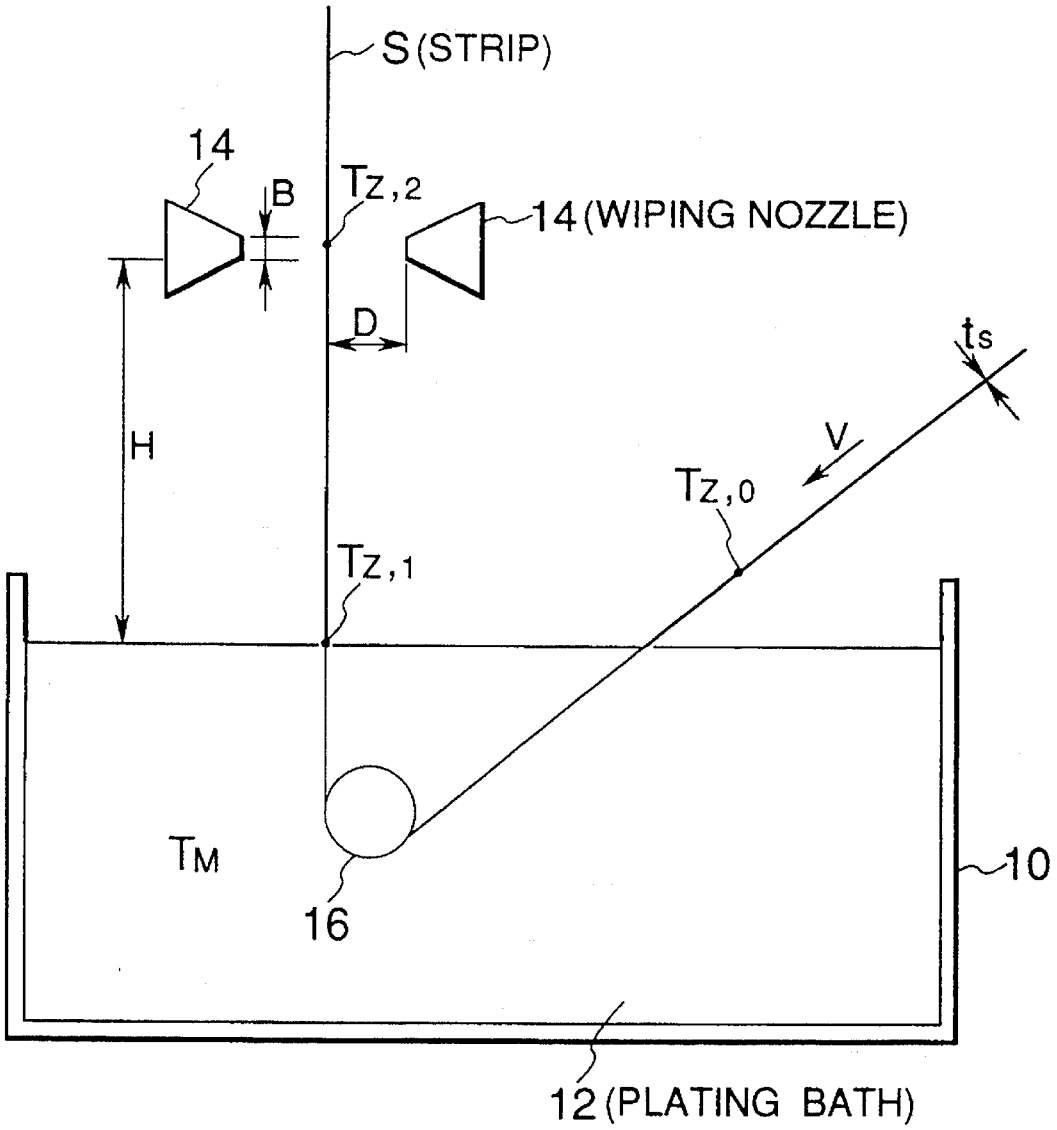
FIG. 2 is a general explanatory view showing a method of molten metal plating.
Figure 3:
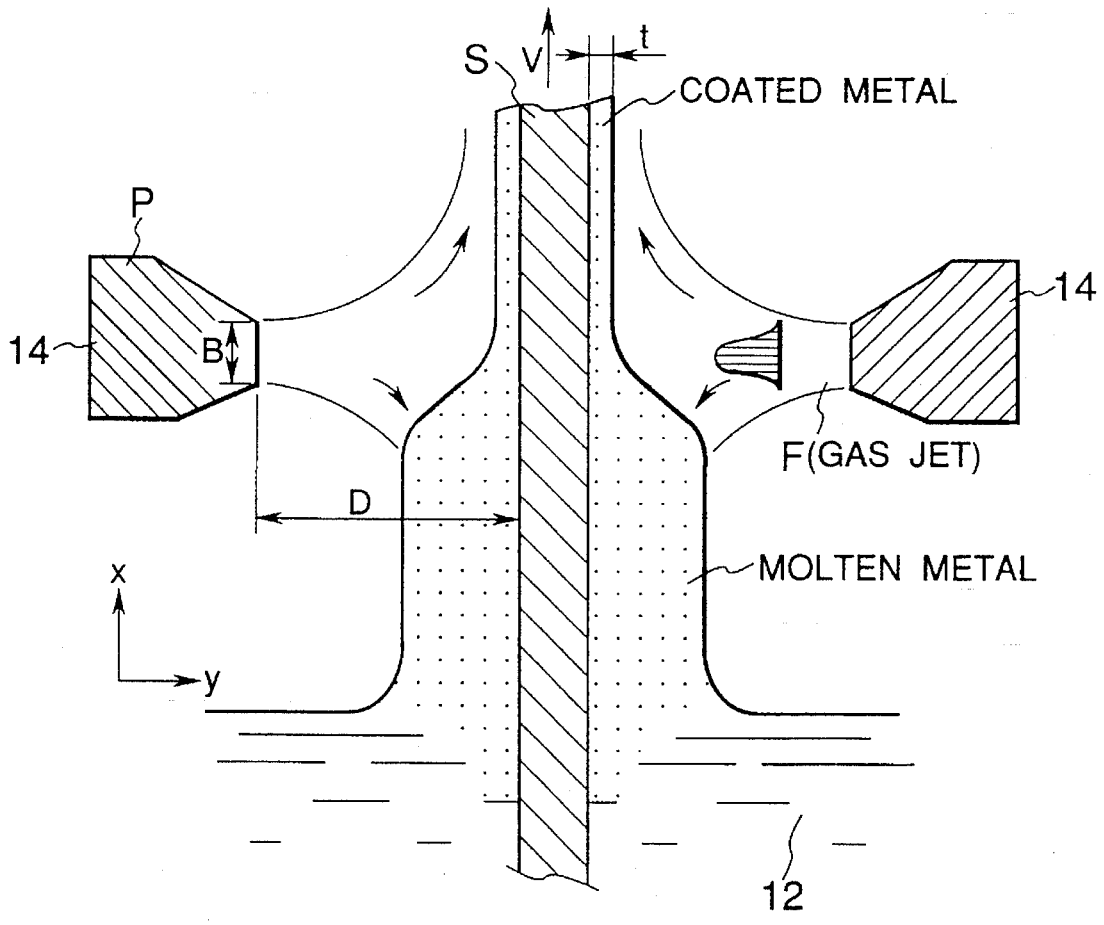
FIG. 3 is a schematic view showing a behavior of wiping molten metal coated on a strip.
Figure 4:
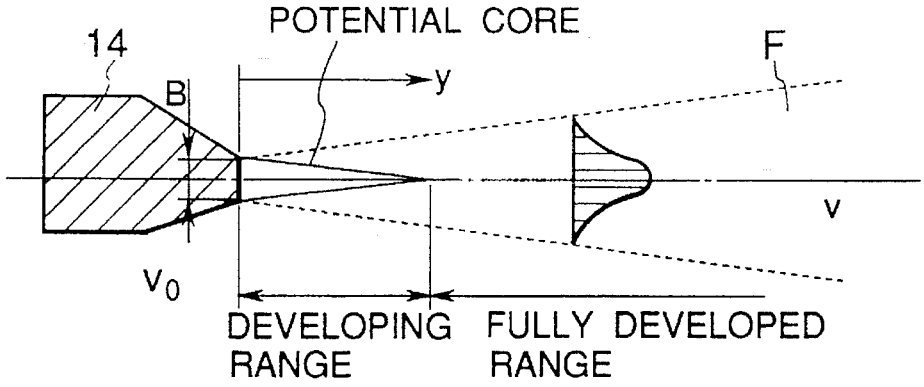
FIG. 4 is a general explanatory view showing the state of gas jet emitted from a wiping nozzle.
Figure 5:
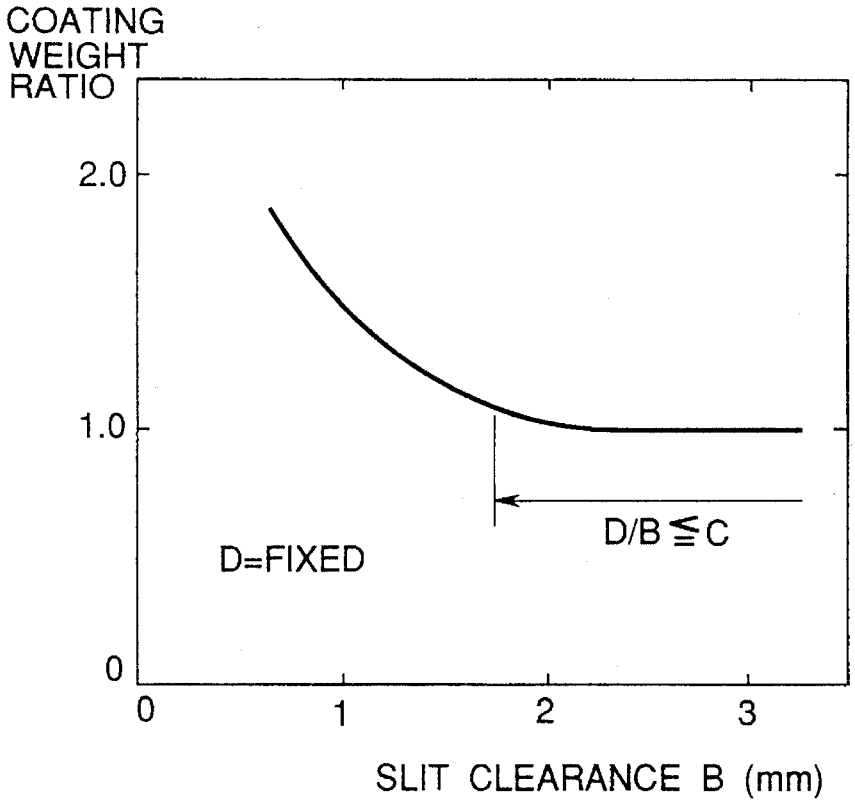
FIG. 5 is a diagram showing a relation between a wiping efficiency (ratio of coating weight) and nozzle slit thickness in a developing range.
Figure 6:
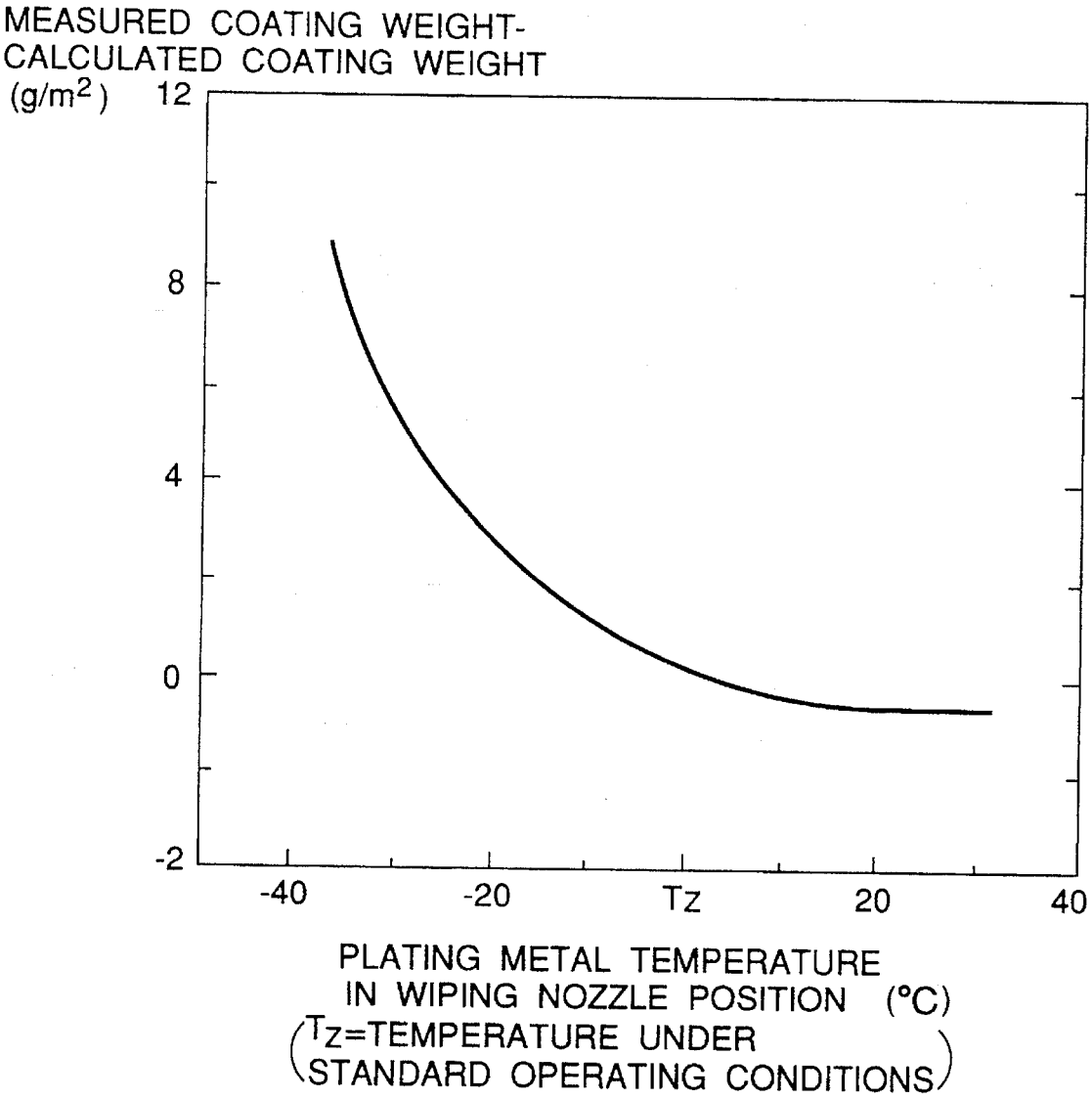
FIG. 6 is a diagram showing a relation between plating metal temperature and plate coating weight error in a wiping nozzle position.
Figure 7:
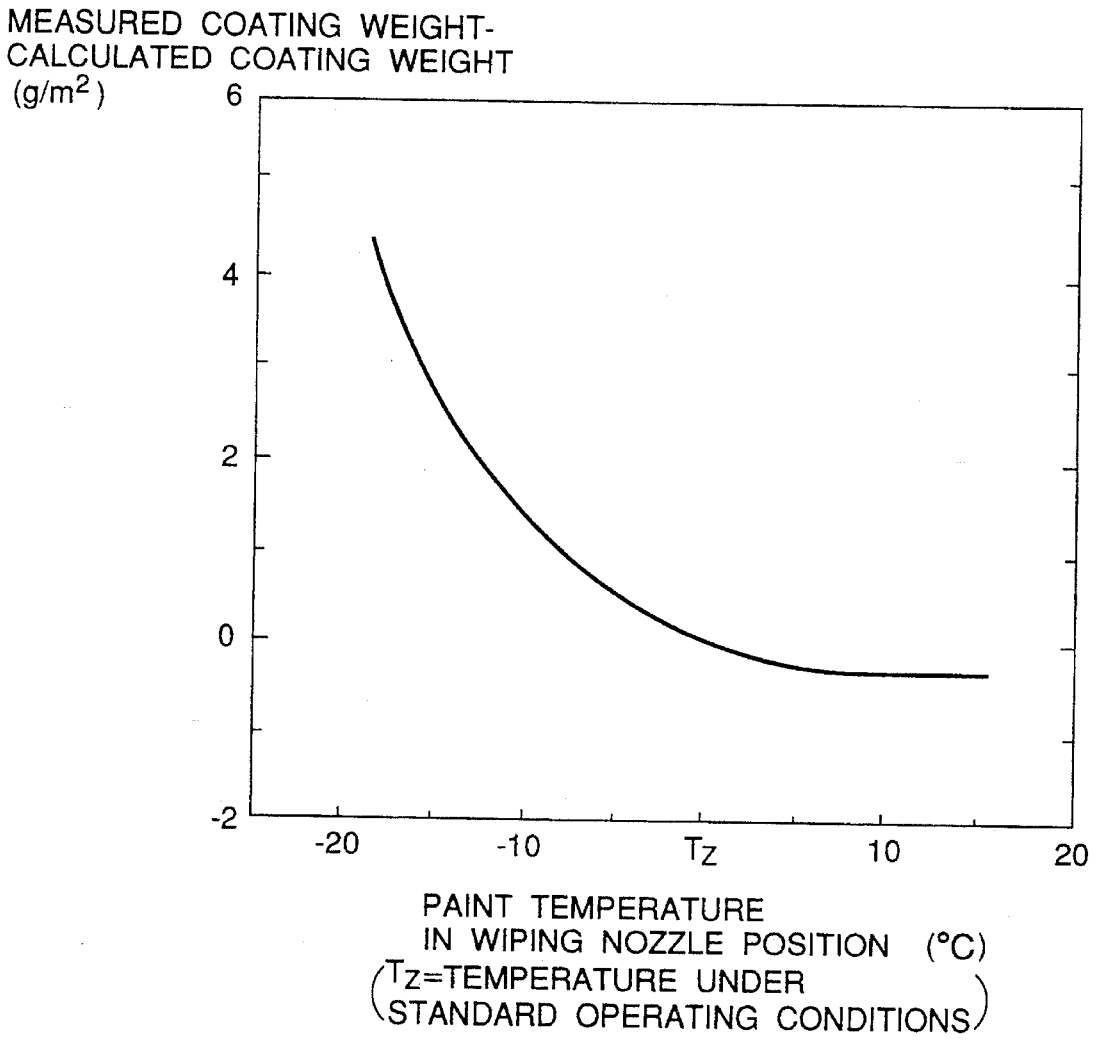
FIG. 7 is a diagram showing a relation between paint temperature and paint coating weight error in the wiping nozzle position.

FIG. 1B shows a result of control of the coating weight of plating effected by a prior art method using the same control apparatus and a relational formula of the coating weight which is expressed by the following equation (21) prepared as a regression equation of operation factors. When the prior art method is used in the control, the nozzle slit clearance B is not taken into consideration and besides the physical properties of the molten zinc is also not taken into consideration.

$$W=k_1\times P^{C1}\times V^{C2}\times D^{C3} \tag{21}$$

where k=constant

C1, C2, C3=power constants of P, V, D

TABLE 1

| | |
|---|---|
| Strip speed (m/min) | 60~160 |
| Strip thickness (mm) | 0.4~2.0 |
| Strip width (mm) | 900~1620 |
| Wiping gas pressure (kg/cm$^2$) | 0.15~1.1 |
| Nozzle distance (mm) | 10~30 |
| Target value of coating weight (g/m$^2$) | 30, 45, 60, 90 |
| Nozzle slit clearance (mm) | 0.6~2.0 |
| Nozzle-to-plating bath surface distance (mm) | 200~600 |

According to the prior art method, it is seen from FIG. 1 that the coating weight varies with the timing of change in the strip speed, target coating weight, and shape of strip, and that a deviation occurs even in a steady state in which no change arises in the operating conditions. On the other hand, according to the method of the present invention, it is possible to control the coating weight nearly to the target coating weight regardless of various changes in the operating conditions.

Next, a second embodiment will be explained.

In the present embodiment, the adjustment of the coating weight of plating is made by controlling at least one of D and B within the developing range, that is, within the range satisfying D/B≦C.

Table 3 shows a result of hot-dip galvanizing carried out under the operating conditions shown in Table 2 given below, by the use of the same control apparatus as in the case of the first embodiment.

TABLE 2

| | |
|---|---|
| Strip speed (m/min) | 60~160 |
| Strip thickness (mm) | 0.5~2.3 |
| Strip width (mm) | 850~1800 |
| Nozzle distance (mm) | 10~35 |
| Target value of coating weight (g/m$^2$) | 30~120 |
| Nozzle slit clearance (mm) | 0.6~2.3 (Prior art: 1.8) |
| Nozzle-to-plating bath surface distance (mm) | 200~500 |

TABLE 3

| | Prior Art (std) | Present Invention |
|---|---|---|
| Wiping gas flow rate | 1.0 | 0.65 |
| Amount of splash | 1.0 | 0.15 |
| Limit nozzle pressure | 1.0 | 1.6 |

Table 3 shows mean values; as compared with those in the prior art case, the wiping gas flow rate (gas consumption) can be reduced, the amount of splash can be decreased; and furthermore the nozzle pressure can be increased within the range not adversely affecting the plating operation (in the above table the wiping gas flow rate 1.0 corresponds to 5,500 Nm$^3$/hr, and the limit nozzle pressure 1.0 corresponds to 0.65 kgG. The amount of splash is measured by visual observation.).

Since the nozzle pressure can be set high as stated above, the coating weight control range can be widened, enabling thin-coat plating even at a high line speed.

Next explained is a third embodiment, which is an example of application of the present invention to continuous coating.

The continuous coating control apparatus adopted in the present embodiment is substantially the same as the molten metal plating control apparatus used in the first embodiment except for the replacement of the plating tank 10 with the continuous coating apparatus and the plating bath 12 with an immersion paint bath in FIG. 8.

Using the above-described continuous coating control apparatus, the control of the coating weight (coated film thickness) of paint was conducted by using the equations (15) and (16), and a result shown in FIG. 9 was obtained.

Figure 9A:
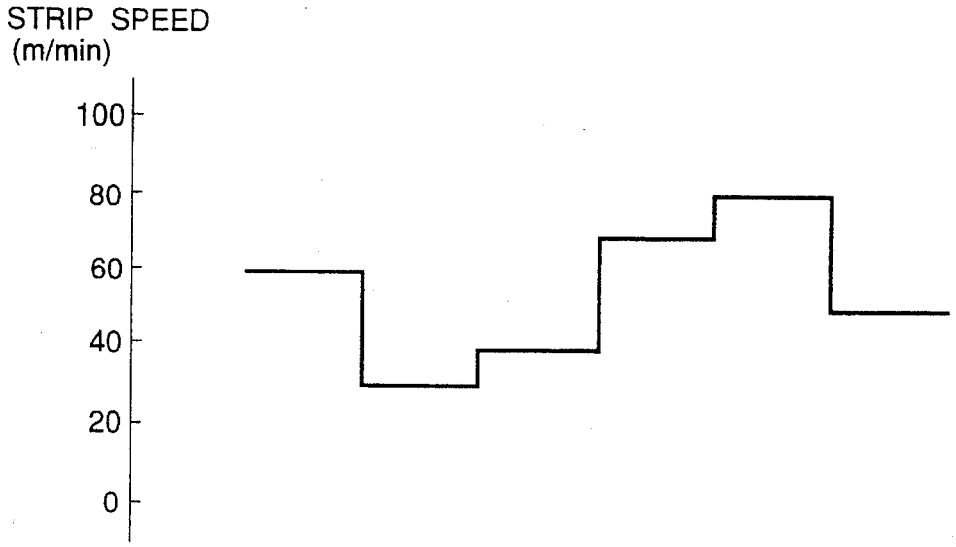
FIGS. 9A and 9b are diagrams showing a result of paint film thickness control according to a third embodiment of the present invention.
Figure 9B:
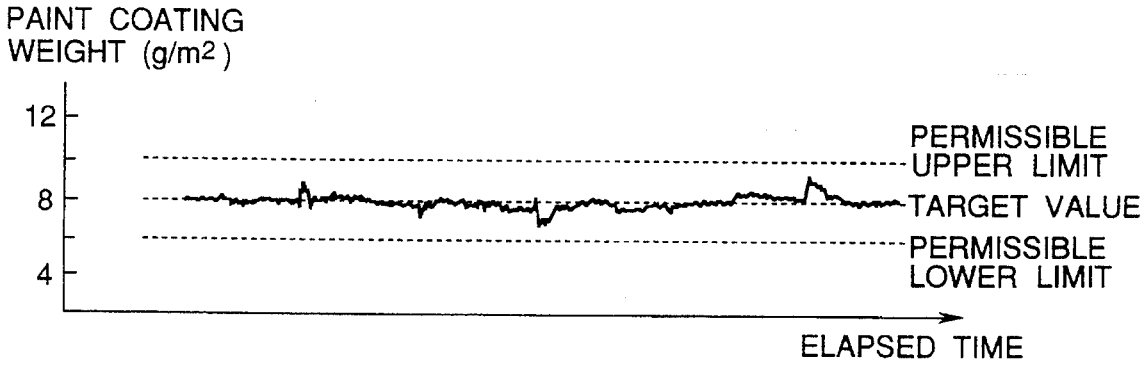

FIG. 9B shows a result of control of the coating weight of paint obtained by using the equations (15) and (16), with the coated paint temperature in the wiping position taken into consideration, when the strip speed is changed as shown in FIG. 9A.

The paint used is a water-soluble paint having the viscosity of 2 cP and the paint density of 1100 kg/m$^3$. The paint temperature in the immersion bath 12 is 30+ C., and the strip temperature before immersion is 35° C. At this time, the coated paint temperature at the wiping point varies with the strip speed: high at a high speed and low at a low speed. The paint temperature was 22° to 30° C. at this control time.

After the application of the above paint under the operating conditions given in Table 4, the solvent is evaporated by baking to thereby form an about 1 μm-thick coating.

TABLE 4

| | |
|---|---|
| Strip speed (m/min) | 30~80 |
| Strip thickness (mm) | 1.2 |
| Strip width (mm) | 1200 |
| Wiping gas pressure (kg/cm$^2$) | 0.1~0.7 |
| Nozzle distance (mm) | 10~30 |
| Target value of coating weight (g/m$^2$) | 8 |
| Nozzle slit clearance (mm) | 0.6~2.0 |
| Nozzle-to-immersion bath surface distance (mm) | 300~500 |

Figure 10A:
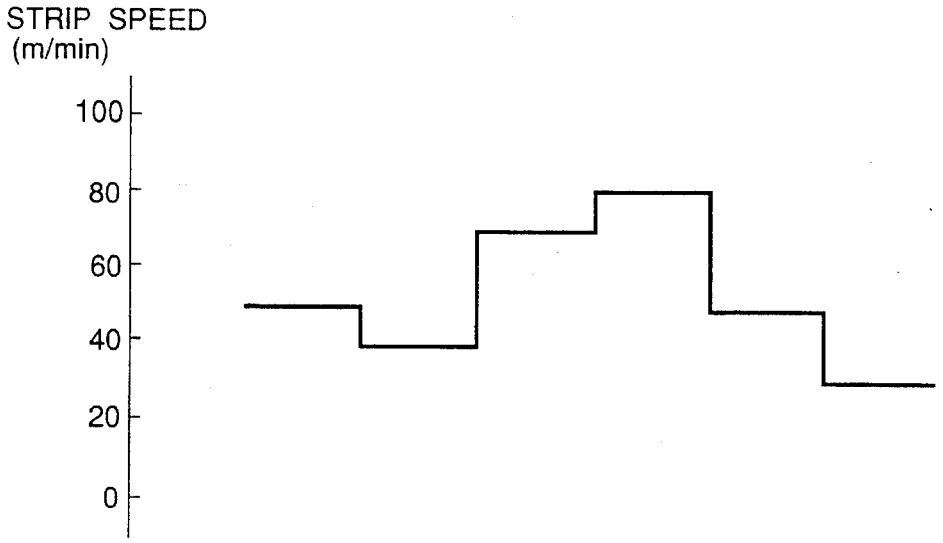
FIGS. 10A and 10B are diagrams showing a result of paint film thickness control according to a prior art method.
Figure 10B:
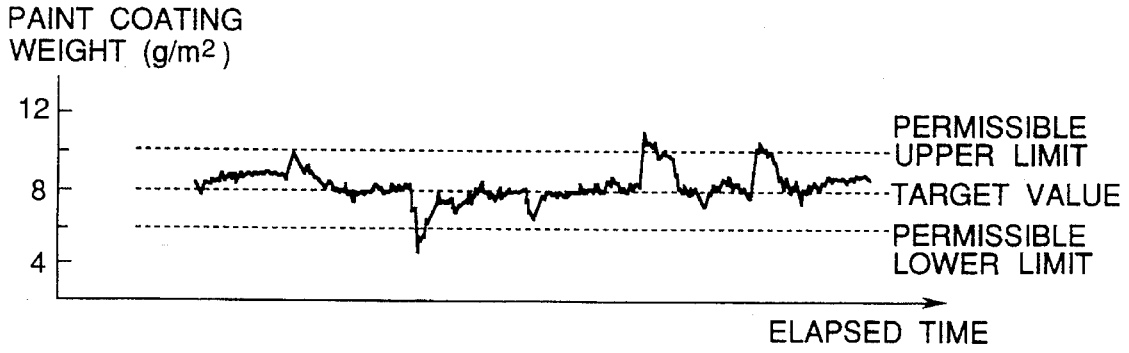

FIG. 10 is a diagram corresponding to FIG. 9 which shows a result of control of the paint coating weight performed by a prior art method using the same control apparatus and a relational formula of the coating weight which is expressed by the following equation (22) prepared as a regression equation of operation factors. When the prior art method is adopted to make this control, both the nozzle slit clearance B and the physical properties of the paint are not taken into consideration.

$$W=k_2\times P^{C4}\times V^{C5}\times D^{C6} \tag{22}$$

where $k_2$=constant

C4, C5, C6=power constants of P, V and D

From FIGS. 9 and 10 it is clear that the coating weight varies with the timing of change in the strip speed, and that a deviation occurs even in a steady state in which no speed change arises. On the other hand, according to the method of the present invention, it is possible to control the coating weight nearly to the target coating weight regardless of the speed change.

The present invention has heretofore been explained concretely. It should be noted that the present invention is not limited to the embodiment explained above and various modifications are possible within the scope and spirit of the present invention.

For example, a relational formula (a control equation) to be used for controlling the coating weight of a coating material such as molten metal or paint is not limited to the equation (15) or (16) and changes may be made as desired so long as they control the coating weight of the coating material by a control equation exclusive of the nozzle slit clearance B in the range of D/B≦C (developing range), and by a control equation inclusive of the nozzle-strip distance D and the slit clearance B in the range of D/B>C (fully developed range).

For example, it is possible to alter the equations (15) and (16) for controlling the coating weight of the coating material by the use of a control equation exclusive of the nozzle slit clearance B and inclusive of at least the nozzle-strip distance D, wiping gas pressure P, and strip speed V in the range of D/B≦C (developing range), and by the use of a control equation inclusive of at least the nozzle-strip distance D, slit clearance B, wiping gas pressure P, and strip speed V in the range of D/B>C (fully developed range). It should be noted that, at this time, the power constants of each factor and the constants in the control equation can be fitted to an actually measured value.

Also it is to be noticed that the equation for evaluating the viscosity of the coating material as a function of temperature is not limited to the equation (19).

Furthermore, it is to be noticed that the molten metal plating control apparatus for actual use is not limited to that shown in the embodiment previously described, and also the type of plating is not limited to galvanizing.

Furthermore, the continuous coating control apparatus is not limited to the device equipped with the immersion bath shown in the above-described embodiment as the continuous coating apparatus; for example, the apparatus may be changed as desired to one equipped with an apparatus such as a spray nozzle which can continuously apply the paint to the strip. Also the type of paint is not limited to that shown in the embodiment described above.

CAPABILITY OF EXPLOITATION IN INDUSTRY

According to the present invention, as heretofore explained, it is possible to control the coating weight of the coating material to a target value even when a change is made in the operation factors owing to changes in the type of product and the shape of strip, by setting and using a relational formula for determining the coating weight of the coating material such as molten metal and paint on the basis of a relative relation between the nozzle-strip distance D and the nozzle slit clearance B.

Also it becomes possible to adjust the coating weight of the coating material under conditions of high wiping efficiency by applying the above-described relational formula by which the coating weight of the coating material is determined while maintaining the D/B value within the developing range, to diminish the wiping gas flow rate and the amount of splash throughout a wide range of operation, and further to increase the limit nozzle pressure, thereby enabling an increased production of products.

We claim:

1. A method for coating a coating material on a strip, said method comprising coating a coating material on a strip with a continuous coating apparatus and subsequently applying blasts of gas from a wiping nozzle disposed downstream from said continuous coating apparatus against said strip to achieve a coating weight of said coating material, wherein the coating weight of said coating material is adjusted in said process to a target coating weight W according to the relational formulae:

$$W=h_{1/2}\times\rho_M\times\{(K-1)/(2\times\eta\times K\times P_A\}^{1/2}\times D^{1/2}\times[\mu\times V/\{(P/P_A)^{(K-1)/K}-1\}] \quad \text{(i)}$$

when

D/B≦C and $$W=h_2\times\rho_M\times\{(K-1)/(2\times\eta\times K\times P_A\}^{1/2}\times(D/B^{1/2})\times[\mu\times V/\{(P/P_A)^{(K-1)/K}-1\}]^{1/2} \quad \text{(ii)}$$

when

D/B>C, by adjusting at least one of a wiping nozzle slit clearance B or a wiping nozzle to strip distance D to achieve said target coating weight, wherein C is a constant corresponding to a boundary between a developing range and a fully developed range of a gas jet from said wiping nozzle, and wherein $h_1$ and $h_2$=constants;

$\rho_M$=coating density;

K=ratio of specific heat of gas;

η=nozzle efficiency;

$P_A$=pressure at nozzle outlet section;

P=nozzle pressure;

μ=coating material viscosity; and

V=strip speed.

2. The method according to claim 1, wherein said coating weight is adjusted by adjusting at least one of said wiping nozzle slit clearance B or said wiping nozzle to strip distance D while maintaining the relation of D/B≦C.

3. A method for coating a metal on a strip, said method comprising coating a molten metal on a strip by passing said strip through a molten metal bath and subsequently applying blasts of gas from a wiping nozzle disposed downstream from said molten metal bath against said strip to achieve a coating weight of said molten metal, wherein the coating weight of said molten metal is adjusted in said process to a target coating weight W according to the relational formulae:

$$W=h_{1/2}\times\rho_M\times\{(K-1)/(2\times\eta\times K\times P_A\}^{1/2}\times D^{1/2}\times[\mu\times V/\{(P/P_A)^{(K-1)/K}-1\}] \quad \text{(i)}$$

when

D/B≦C and $$W=h_2\times\rho_M\times\{(K-1)/(2\times\eta\times K\times P_A\}^{1/2}\times(D/B^{1/2})\times[\mu\times V/\{(P/P_A)^{(K-1)/K}-1\}]^{1/2} \quad \text{(ii)}$$

when

D/B>C, by adjusting at least one of a wiping nozzle slit clearance B or a wiping nozzle to strip distance D to achieve said target coating weight, wherein C is a constant corresponding to a boundary between a developing range and a fully developed range of a gas jet from said wiping nozzle, and wherein $h_1$ and $h_2$=constants;

$\rho_M$=molten metal density;

K=ratio of specific heat of gas;

η=nozzle efficiency;

$P_A$=pressure at nozzle outlet section;

P=nozzle pressure;

μ=viscosity of molten metal; and

V=strip speed.

4. The method according to claim 3, wherein said coating weight is adjusted by adjusting at least one of said wiping nozzle slit clearance B or said wiping nozzle to strip distance D while maintaining the relation of D/B≦C.

5. A method for coating a paint on a strip, said method comprising coating a paint on a strip with a continuous coating apparatus and subsequently applying blasts of gas from a wiping nozzle disposed downstream from said continuous coating apparatus against said strip to achieve a coating weight of said paint, wherein the coating weight of said paint is adjusted in said process to a target coating weight W according to the relational formulae:

$$W=h_{1/2}\times\rho_M\times\{(K-1)/(2\times\eta\times K\times P_A\}^{1/2}\times D^{1/2}\times[\mu\times V/\{(P/P_A)^{(K-1)/K}-1\}] \quad \text{(i)}$$

when

D/B≦C and $$W=h_2\times\rho_M\times\{(K-1)/(2\times\eta\times K\times P_A\}^{1/2}\times(D/B^{1/2})\times[\mu\times V/\{(P/P_A)^{(K-1)/K}-1\}]^{1/2} \quad \text{(ii)}$$

when

D/B>C, by adjusting at least one of a wiping nozzle slit clearance B or a wiping nozzle to strip distance D to achieve said target coating weight, wherein C is a constant corresponding to a boundary between a developing range and a fully developed range of a gas jet from said wiping nozzle, and wherein $h_1$ and $h_2$=constants;

$\rho_M$=coating density;

K=ratio of specific heat of gas;

$\eta$=nozzle efficiency;

$P_A$=pressure at nozzle outlet section;

P=nozzle pressure;

$\mu$=coating material viscosity; and

V=strip speed.

6. The method according to claim 5, wherein said coating weight is adjusted by adjusting at least one of said wiping nozzle slit clearance B or said wiping nozzle to strip distance D while maintaining the relation of $D/B \leqq C$.

* * * * *